US005350639A

United States Patent [19]

Inoue et al.

[11] Patent Number: 5,350,639

[45] Date of Patent: Sep. 27, 1994

[54] DIELECTRIC CERAMIC FOR USE IN MICROWAVE DEVICE, A MICROWAVE DIELECTRIC CERAMIC RESONATOR DIELECTRIC CERAMICS

[75] Inventors: Tatsuya Inoue; Hiroshi Kagata; Junichi Kato; Ichiro Kameyama, all of Osaka, Japan

[73] Assignee: Matsushita Electric Industrial Co., Ltd., Osaka, Japan

[21] Appl. No.: 941,961

[22] Filed: Sep. 8, 1992

[30] Foreign Application Priority Data

| | | | |
|---|---|---|---|
| Sep. 10, 1991 | [JP] | Japan | 3-230158 |
| Sep. 10, 1991 | [JP] | Japan | 3-230419 |
| Feb. 28, 1992 | [JP] | Japan | 4-042877 |

[51] Int. Cl.[5] ..... H01P 7/00

[52] U.S. Cl. ..... 428/633; 428/632; 428/671; 501/134; 333/219.1

[58] Field of Search ..... 501/134; 333/219.1; 428/632, 671, 633

[56] References Cited

U.S. PATENT DOCUMENTS

| | | | |
|---|---|---|---|
| 4,687,540 | 8/1987 | Singhdeo et al. | 428/632 |
| 4,785,271 | 11/1988 | Higgins, Jr. | 333/219 |
| 4,785,375 | 11/1988 | Campbell | 252/62.3 BT |
| 4,918,050 | 4/1990 | Dworsky | 333/219 |
| 4,978,881 | 12/1990 | Wakita et al. | 310/328 |
| 5,004,713 | 4/1991 | Bardhan et al. | 501/135 |
| 5,028,348 | 7/1991 | Konoike et al. | 252/62.59 |
| 5,105,176 | 4/1992 | Okamura et al. | 333/219 |

FOREIGN PATENT DOCUMENTS

| | | | |
|---|---|---|---|
| 0190574 | 8/1986 | European Pat. Off. . | |
| 52-32600 | 3/1977 | Japan | 501/134 |
| 62-12002 | 1/1987 | Japan . | |
| 2-172106 | 7/1990 | Japan . | |
| 3-53407 | 3/1991 | Japan . | |
| 3-53408 | 3/1991 | Japan . | |

OTHER PUBLICATIONS

Lanagan et al, "Microwave Dielectric Properties of Antiferroelectric Lead Ziiconate" J. Am. Ceram. Soc., vol. 71 [4], pp. 311–316 (Apr. 1988).

Lanagan et al, "Dielectric Behavior of the Relaxor $Pb(Mg_{\frac{1}{3}}Nb_{\frac{2}{3}})O_3$–$PbTiO_3$ Solid-Solution System in the Microwave Region", Communications of the American Ceramic Society vol. 72, No. 3, pp. 481–483, (Mar. 1989).

*Primary Examiner*—Michael Lewis
*Assistant Examiner*—N. M. Nguyen
*Attorney, Agent, or Firm*—Willian Brinks Hofer Gilson and Lione

[57] ABSTRACT

Dielectric ceramics a microwave device made of $(Bi_2O_3)\times(Nb_2O_5)_{1-x}$ includes at least one of subcomponents of CuO and $V_2O_5$, wherein the composition ratio x is fallen into a range of $0.48 \leqq x \leqq 0.51$, an atomic ratio AR1 defined by the following equation:

$$AR1 = (\text{the number of Cu atoms of the CuO})/ARO,$$

where

ARO=(the number of Bi atoms of the $(Bi_2O_3)_x(Nb_2O_5)_{1-x}$)+(the number of Nb atoms of the $(Bi_2O_3)_x(Nb_2O_5)_{1-x}$)

is fallen into a range of $0<AR1<0.01$, and another atomic ratio AR2 defined by the following equation:

$$AR2 = (\text{the number of V atoms of the } V_2O_5)/ARO$$

is fallen into a range of $0<AR2\leqq 0.02$. Further, a microwave dielectric resonator includes a microstrip conductor formed between a plurality of first sheet-shaped dielectric layers and a plurality of second sheet-shaped dielectric layers, wherein the microstrip conductor is electrically connected to one external electrode and the dielectric layers are made of the above-mentioned dielectric ceramics. Furthermore, a process of making a microwave dielectric ceramics resonator includes a step of firing a resonator element in nitrogen atmosphere under a condition of an oxygen concentration equal to or less than 1000 ppm at a temperature in a range from 875° to 1000° C.

12 Claims, 5 Drawing Sheets

DIELECTRIC CERAMIC FOR USE IN MICROWAVE DEVICE, A MICROWAVE DIELECTRIC CERAMIC RESONATOR DIELECTRIC CERAMICS

BACKGROUND OF THE INVENTION

1. Field of the Invention

The present invention relates to dielectric ceramics for use in a microwave device, a microwave dielectric ceramic resonator, and a method of making a microwave dielectric ceramics resonator, more particularly, to dielectric ceramics for use in a microwave device and a microwave dielectric ceramic resonator operating in a microwave band in a frequency range from about 1 GHz, and a method of making a microwave dielectric ceramic resonator.

2. Description of the Related Art

Recently, demand for miniaturization of equipment has arisen along with development of mobile telecommunication devices such as automobile telephones and portable telephones, and along with development of satellite broadcasting system. For this purpose, miniaturization of individual parts which form this equipment is required. For example, lamination of dielectric layers has been suggested in devices such as band-pass filters, resonators and antenna combiners or the like each of which uses dielectric materials.

Generally speaking, the size of devices made of a dielectric material is inversely proportional to a square root of its effective dielectric constant when the same resonance mode is utilized. Therefore, in order to manufacture smaller-sized devices, it is necessary to use a dielectric material having a higher relative dielectric constant. In characteristics other than the aforementioned ones, there are required in the dielectric material (a) a lower loss in the microwave band and (b) a smaller change rate of the resonance frequency in the temperature.

On the other hand, when an electrical conductor is used in a high frequency band such as the microwave band, it is necessary to use as the conductor, Cu, Ag, Au or any of their alloys in order to make its electric conductivity higher. Accordingly, the dielectric material used in any lamination type microwave device using such a conductor must be finely sintered so as to be fine ceramics under firing conditions which do not allow melting nor oxidation of the conductor metal. In other words, when Cu is used as electrodes at such a low temperature as below 1000° C., it is necessary to fire the dielectric material under a low partial pressure of oxygen.

Conventionally, however, a dielectric material having been used in microwave devices used in the microwave band such as $Ba(Mg_{1/3}Ta_{2/3})O_3$, $Ba(Za_{1/3}Ta_{1/3})O_3$, or the like requires such a relatively high firing temperature as above 1300° C. The dielectric material can not be fired simultaneously with an electrode of Cu, Ag, Au, or the like. Conversely, since each of dielectric materials having a relatively low firing temperature utilized for substrates or the like has a relative dielectric constant as small as less than 10, it is difficult to use it as small-sized lamination type devices.

Further, dielectric ceramics of $Bi_2O_3$–$Nb_2O_5$ series are known to those skilled in the art as capacitor materials for temperature compensation (for example, See the Japanese Patent Laid-Open Publication No. 62-012002). These dielectric ceramics require firing temperatures higher than 1000° C. Therefore, their application in the microwave band range has not been studied.

SUMMARY OF THE INVENTION

An object of the present invention is therefore to provide dielectric ceramics for use in a microwave device capable of being sintered at a temperature at which they can be fired simultaneously with a metal or an alloy thereof.

Another object of the present invention is to provide dielectric ceramic for use in a microwave device having a relative dielectric constant in the microwave band larger than that of conventional dielectric ceramic, having a loss lower than that of conventional dielectric ceramic, and having a change rate of the resonance frequency in the temperature smaller than that of conventional dielectric ceramic.

A further object of the present invention is to provide a microwave dielectric ceramic resonator capable of using dielectric ceramic together with an electrical conductor of a metal or an alloy thereof.

A still further object of the present invention is to provide a microwave dielectric ceramic resonator having a relative dielectric constant in the microwave band larger than that of conventional dielectric ceramic, having a loss lower than that of conventional dielectric ceramic, and having a change rate of the resonance frequency in the temperature smaller than that of conventional dielectric ceramic.

A still more further object of the present invention is to provide a microwave dielectric ceramic resonator capable of being miniaturized as compared with the conventional resonator.

A further object of the present invention is to provide a method of making a microwave dielectric ceramic resonator capable of having a Q value higher than that of the conventional resonator.

In order to achieve the aforementioned objective, according to the first aspect of the present invention, there is provided a dielectric ceramic for use in a microwave device comprising $(Bi_2O_3)_x(NbO_5)_{1-x}$ including a subcomponent of CuO, wherein the composition ratio x is within a range of $0.48 \leqq x \leqq 0.51$, and an atomic ratio AR1 defined by the following equation:

$$AR1 = (\text{a number of Cu atoms of said CuO})/ARO,$$

where

ARO=(a number of Bi atoms of said $(Bi_2O_3)_x(Nb_2O_5)_{1-x}$)+(a number of Nb atoms of said $(Bi_2O_3)_x(Nb_2O_5)_{1-x}$) is within a range of $0 < AR1 < 0.01$.

According to the second aspect of the present invention, there is provided a dielectric ceramic for use in a microwave device comprising $(Bi_2O_3)_x(Nb_2O_5)_{1-x}$ including a subcomponent of $V_2O_5$, wherein the composition ratio x is within a range of $0.48 \leqq x \leqq 0.51$, and an atomic ratio AR2 defined by the following equation:

$$AR2 = (\text{a number of V atoms of said } V_2O_5)/ARO$$

is within into a range of $0 < AR2 \leqq 0.02$.

According to the third aspect of the present invention, there is provided a dielectric ceramic for use in a microwave device comprising $(Bi_2O_3)_x(Nb_2O_5)_{1-x}$ including subcomponents of CuO and $V_2O_5$, wherein the composition ratio x is within a range of $0.48 \leqq x \leqq 0.51$, an atomic ratio AR1 defined by the following equation:

$$AR1 = (\text{a number of Cu atoms of said CuO})/ARO$$

is within a range of $0 < AR1 \leqq 0.01$, and another atomic ratio AR2 defined by the following equation:

$$AR2 = (\text{a number of V atoms of said } V_2O_5)/ARO$$

is within into a range of $0 < AR2 \leqq 0.02$.

According to the fourth aspect of the present invention, there is provided a microwave dielectric resonator comprising:

first and second external electrodes;

first and second conductors electrically connected to said first and second external electrodes, respectively;

a plurality of first sheet-shaped dielectric layers and a plurality of second sheet-shaped dielectric layers both formed between said first and second conductors, said first and second dielectric layers being made of dielectric ceramic; and a microstrip conductor formed between said plurality of first sheet-shaped dielectric layers and said plurality of second sheet-shaped dielectric layers, said microstrip conductor being electrically connected to said second external electrode, wherein each of said first and second conductors and said microstrip conductor is made of either one of Cu, Ag, Au, an alloy of Ag and Pt, an alloy of Ag and Pd, and an alloy of Cu and Pd, and said dielectric ceramic of said first and second sheet-shaped dielectric layers are made of $(Bi_2O_3)_x(Nb_2O_5)_{1-x}$ including a subcomponent of CuO, where the composition ratio x is within into a range of $0.48 \leqq x \leqq 0.51$, and an atomic ratio AR1 defined by the following equation:

$$AR1 = (\text{a number of Cu atoms of said CuO})/ARO$$

is within into a range of $0 < AR1 \leqq 0.01$.

According to the fifth aspect of the present invention, there is provided a microwave dielectric resonator comprising:

first and second external electrodes;

first and second conductors electrically connected to said first and second external electrodes, respectively;

a plurality of first sheet-shaped dielectric layers and a plurality of second sheet-shaped dielectric layers both formed between said first and second conductors, said first and second dielectric layers being made of dielectric ceramic; and a microstrip conductor formed between said plurality of first sheet-shaped dielectric layers and said plurality of second sheet-shaped dielectric layers, said microstrip conductor being electrically connected to said second external electrode, wherein each of said first and second conductors and said microstrip conductor is made of either one of Cu, Ag, Au, an alloy of Ag and Pt, an alloy of Ag and Pd, and an alloy of Cu and Pd, and said dielectric ceramic of said first and second sheet-shaped dielectric layers are made of $(Bi_2O_3)_x(Nb_2O_5)_{1-x}$ including a subcomponent of $V_2O_5$, where the composition ratio x is within a range of $0.48 \leqq x \leqq 0.51$, and an atomic ratio AR2 defined by the following equation:

$$AR2 = (\text{a number of V atoms of said } V_2O_5)/ARO$$

is within into a range of $0 < AR2 \leqq 0.02$.

According to the sixth aspect of the present invention, there is provided a microwave dielectric resonator comprising:

first and second external electrodes;

first and second conductors electrically connected to said first and second external electrodes, respectively;

a plurality of first sheet-shaped dielectric layers and a plurality of second sheet-shaped dielectric layers both formed between said first and second conductors, said first and second dielectric layers being made of dielectric ceramic; and a microstrip conductor formed between said plurality of first sheet-shaped dielectric layers and said plurality of second sheet-shaped dielectric layers, said microstrip conductor being electrically connected to said second external electrode, wherein each of said first and second conductors and said microstrip conductor is made of either one of Cu, Ag, Au, an alloy of Ag and Pt, an alloy of Ag and Pd, and an alloy of Cu and Pd, and said dielectric ceramic of said first and second sheet-shaped dielectric layers are made of $(Bi_2O_3)_x(Nb_2O_5)_{1-x}$ including at least subcomponents of CuO and $V_2O_5$, where the composition ratio x is within into a range of $0.48 \leqq x \leqq 0.51$, an atomic ratio AR1 defined by the following equation:

$$AR1 = (\text{a number of Cu atoms of said CuO})/ARO$$

is within into a range of $0 < AR1 \leqq 0.01$, and another atomic ratio AR2 defined by the following equation:

$$AR2 = (\text{a number of V atoms of said } V_2O_5)/ARO$$

is within a range of $0 < AR2 \leqq 0.02$.

According to the seventh aspect of the present invention, there is provided a method of making a microwave dielectric ceramic resonator including the following steps of:

forming a plurality of first sheet-shaped dielectric layers;

forming a microstrip conductor formed on said plurality of first sheet-shaped dielectric layers, said microstrip conductor being made of either one of Ag, Au and an alloy of Ag and Pt;

forming a plurality of second sheet-shaped dielectric layers on said microstrip conductor formed on said first sheet-shaped dielectric layers so that said microstrip conductor is formed between said first and second sheet-shaped dielectric layers;

forming first and second conductors on the outside surface of said first sheet-shaped dielectric layers and the outside surface of said second sheet-shaped dielectric layers, respectively, said first and second conductors being made of made of either one of Ag, Au and an alloy of Ag and Pt, thereby obtaining a resonator element;

firing said resonator element in nitrogen atmosphere under a condition of an oxygen concentration equal to or less than 1000 ppm at a temperature in a range from 875° to 1000° C.; and forming first and second external electrodes so as to be electrically connected to said first conductor, and said second conductors and said microstrip conductor, respectively, thereby obtaining a microwave dielectric resonator, wherein said dielectric ceramic of said first and second sheet-shaped dielectric layers are made of $(Bi_2O_3)_x(Nb_2O_5)_{1-x}$ including a subcomponent of CuO, where the composition ratio x is within a range of $0.48 \leqq x \leqq 0.51$, and an atomic ratio AR1 defined by the following equation:

$$AR1 = (\text{a number of Cu atoms of said CuO})/ARO$$

is within into a range of $0 < AR1 \leqq 0.01$.

According to the eighth aspect of the present invention, there is provided a method of making a microwave dielectric ceramic resonator including the following steps of:

forming a plurality of first sheet-shaped dielectric layers;

forming a microstrip conductor formed on said plurality of first sheet-shaped dielectric layers, said microstrip conductor being made of either one of Ag, Au and an alloy of Ag and Pt;

forming a plurality of second sheet-shaped dielectric layers on said microstrip conductor formed on said first sheet-shaped dielectric layers so that said microstrip conductor is formed between said first and second sheet-shaped dielectric layers;

forming first and second conductors on the outside surface of said first sheet-shaped dielectric layers and the outside surface of said second sheet-shaped dielectric layers, respectively, said first and second conductors being made of made of either one of Ag, Au and an alloy of Ag and Pt, thereby obtaining a resonator element;

firing said resonator element in nitrogen atmosphere under a condition of an oxygen concentration equal to or less than 1000 ppm at a temperature in a range from 875° to 1000° C.; and forming first and second external electrodes so as to be electrically connected to said first conductor, and said second conductors and said microstrip conductor, respectively, thereby obtaining a microwave dielectric resonator, wherein said dielectric ceramic of said first and second sheet-shaped dielectric layers are made of $(Bi_2O_3)_x(Nb_2O_5)_{1-x}$ including a subcomponent of $V_2O_5$, where the composition ratio x is within a range of $0.48 \leqq x \leqq 0.51$, and an atomic ratio AR2 defined by the following equation:

$$AR2 = (\text{a number of V atoms of said } V_2O_5)/ARO$$

is within a range of $0 < AR2 \leqq 0.02$.

According to the ninth aspect of the present invention, there is provided a method of making a microwave dielectric ceramic resonator including the following steps of:

forming a plurality of first sheet-shaped dielectric layers;

forming a microstrip conductor formed on said plurality of first sheet-shaped dielectric layers, said microstrip conductor being made of either one of Ag, Au and an alloy of Ag and Pt;

forming a plurality of second sheet-shaped dielectric layers on said microstrip conductor formed on said first sheet-shaped dielectric layers so that said microstrip conductor is formed between said first and second sheet-shaped dielectric layers;

forming first and second conductors on the outside surface of said first sheet-shaped dielectric layers and the outside surface of said second sheet-shaped dielectric layers, respectively, said first and second conductors being made of made of either one of Ag, Au and an alloy of Ag and Pt, thereby obtaining a resonator element;

firing said resonator element in nitrogen atmosphere under a condition of an oxygen concentration equal to or less than 1000 ppm at a temperature in a range from 875° to 1000° C.; and forming first and second external electrodes so as to be electrically connected to said first conductor, and said second conductors and said microstrip conductor, respectively, thereby obtaining a microwave dielectric resonator, wherein said dielectric ceramic of said first and second sheet-shaped dielectric layers are made of $(Bi_2O_3)_x(Nb_2O_5)_{1-x}$ including subcomponents of CuO and $V_2O_5$, where the composition ratio x is within a range of $0.48 \leqq \leqq \leqq 0.51$, an atomic ratio AR1 defined by the following equation:

$$AR1 = (\text{a number of Cu atoms of said CuO})/ARO$$

is within into a range of $0 < AR1 \leqq 0.01$, and another atomic ratio AR2 defined by the following equation:

$$AR2 = (\text{a number of V atoms of said } V_2O_5)/ARO$$

is within a range of $0 < AR2 \leqq 0.02$.

BRIEF DESCRIPTION OF THE DRAWINGS

These and other objects and features of the present invention will become clear from the following description taken in conjunction with the preferred embodiments thereof with reference to the accompanying drawings throughout which like parts are designated by like reference numerals, and in which.

DETAILED DESCRIPTION OF THE PREFERRED EMBODIMENTS

Figure 1:
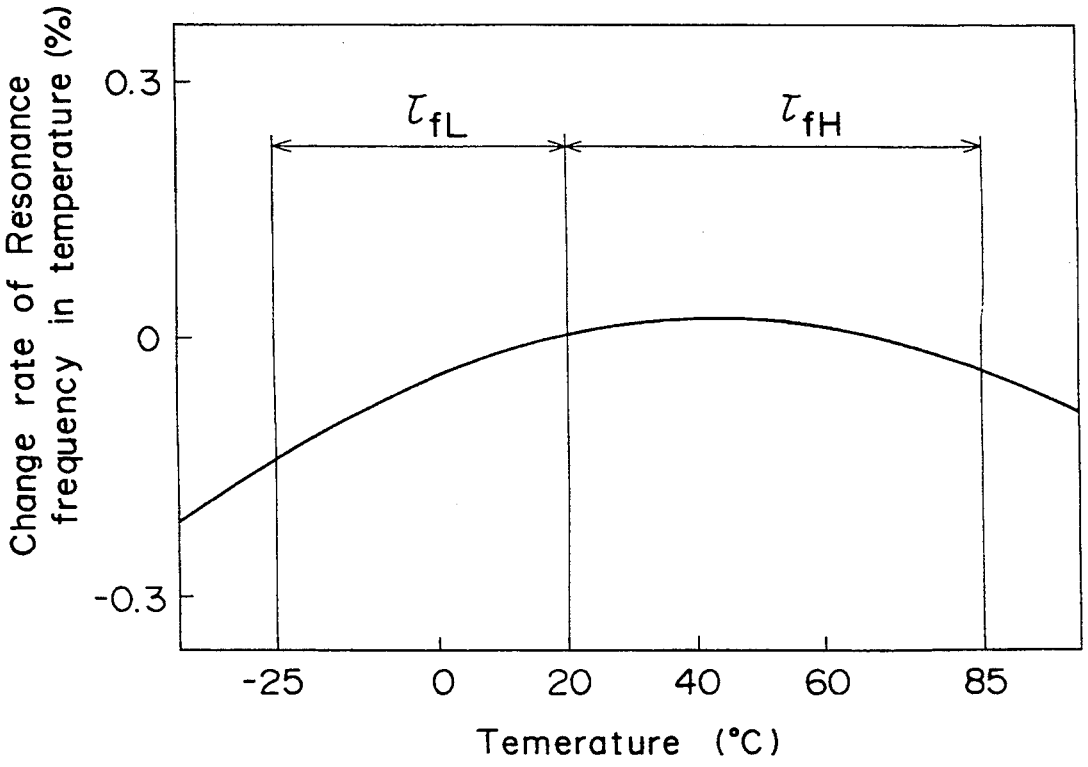
FIG. 1 is a graph showing a characteristic of a change rate of a resonance frequency in temperature on the temperature of dielectric ceramic of preferred embodiments according to the present invention.

Preferred embodiments according to the present invention will be described below with reference to the attached drawings.

FIRST PREFERRED EMBODIMENT

A process of making dielectric ceramic for use in microwave devices of a first preferred embodiment according to the present invention will be described below.

First of all, as starting materials, $Bi_2O_3$, $Nb_2O_5$, CuO and $V_2O_5$ each having a high purity i.e., having almost no impurity were used. Then, after correcting their purities, these materials were weighed by specified weight amounts, and were mixed for 17 hours in a ball mill using balls made of stabilized zirconia with pure water used as a solvent. Thereafter, the mixture was subjected to suction filtration thereby separating almost all the water content thereof from the mixture, followed by drying the mixture. The mixture was put in an alumina crucible to be calcined for 2 hours at a temperature in a range of 700° to 800° C. This calcined product was then roughly crushed in an alumina mortar, and was further pulverized for 17 hours in a ball mill using balls made of stabilized zirconia with pure water used as a solvent. Thereafter, almost all the water content thereof was separated by suction filtration, being followed by drying it. Then, the dried product was comminuted in an alumina mortar, and into it was added 6 wt% of a 5% aqueous solution of polyvinyl alcohol as a binder in proportion to the amount of the powder. Thereafter, the powder was screened through a 32-mesh sieve, and then, the screened power was molded under a pressure of 100 MPa into a cylindrical shape with a diameter of 13 mm and a height of about 5 mm. The made mold was heated in air to 600° C. and thereafter maintained at the same temperature for 2 hours, thereby burning out the content of polyvinyl alcohol. After cooling the mold was transferred to a magnesia ceramic container and was covered with a cover of the same material as the magnesia ceramic. The mold transferred in the magnesia ceramics container was heated or fired at a temperature being raised to a predetermined firing temperature as mentioned later at a rate of 400° C. per hour, and thereafter maintained at the firing temperature for 2 hours. Thereafter, the temperature was lowered at a rate of 400° C. per hour, and then, there was obtained dielectric ceramic of $(Bi_2O_3)_x(Nb_2O_5)_{1-x}$ including subcomponents of at least one of CuO and $V_2O_5$, wherein x is referred to as a composition ratio x hereinafter.

In the present preferred embodiments, atomic ratios AR1 and AR2 converted from the weight ratios by predetermined calculations are defined as follows:

$$AR1 = (\text{a number of Cu atoms of said CuO})/ARO, \quad (1)$$

and $$AR2 = (\text{a number of V atoms of said } V_2O_5)/ARO, \quad (2)$$

where $$ARO = (\text{a number of Bi atoms of said } (Bi_2O_3)_x(Nb_2O_5)_{1-x}) + (\text{a number of Nb atoms of said } (Bi_2O_3)_x(Nb_2O_5)_{1-x}).$$

Figure 2:
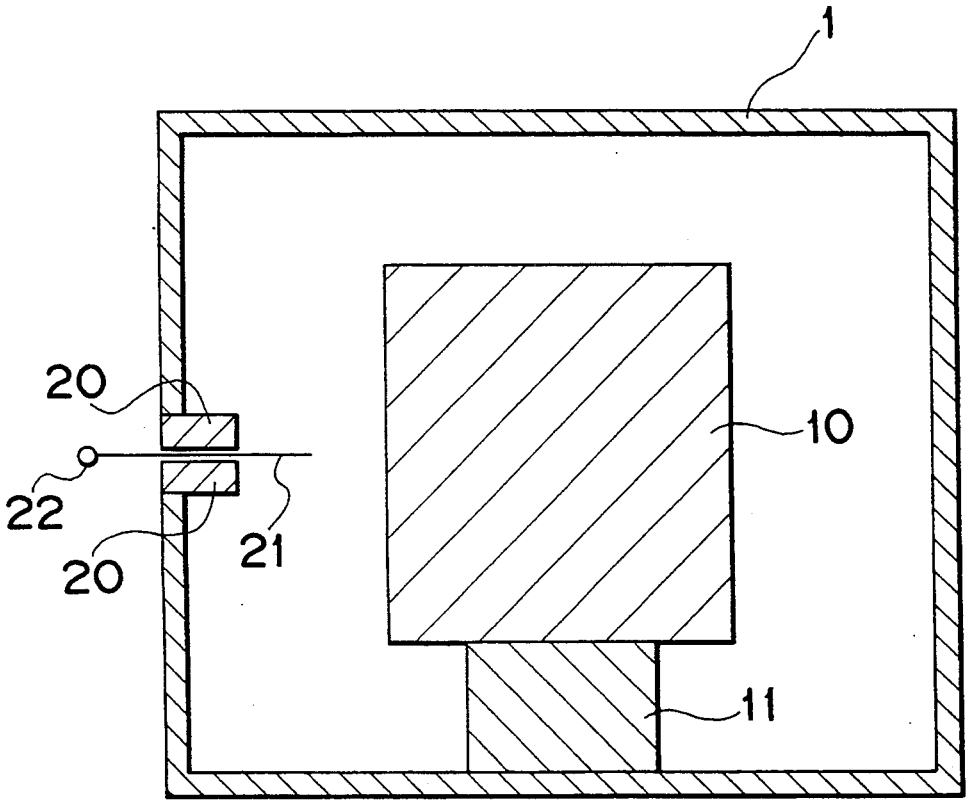
FIG. 2 is a longitudinal cross-sectional view showing a cylinder-shaped dielectric resonator of a first preferred embodiment according to the present invention.

FIG. 2 shows a cylinder-shaped dielectric resonator 10 comprising the obtained dielectric ceramic of the first preferred embodiment according to the present invention. Referring to FIG. 2, the cylinder-shaped dielectric resonator 10 of the obtained dielectric ceramic 10 is arranged on a support table 11 so as to be located in the center of an electrically conductive case 1 having a shape of rectangular parallelepiped. Further, a loop electrode 21 is mounted through an electrically insulating body 20 in a side surface of the case 1 so as to cross or electrically catch an electromagnetic field to be generated from the dielectric resonator 10 when exciting the dielectric resonator 10, resulting in a dielectric resonator apparatus using the cylinder-shaped dielectric ceramic.

The resonance frequency and the Q value of each of the dielectric resonator apparatuses including the obtained respective product of dielectric ceramic thus fired were measured using the dielectric resonance method of the $TE_{01\delta}$ mode known to those skilled in the art. Further, the relative dielectric constant thereof was calculated from the measured dimensions of the obtained product and a resonance frequency thereof measured by a measurement using the $TE_{011}$ mode in such a state that the obtained product was mounted between electrodes of electrically conductive metal plates parallel to each other. The resonance frequency of each product of dielectric ceramic was found to be within a frequency range from 4 to 5 GHz.

A change rate of the resonance frequency in the temperature of each of the dielectric resonators of the dielectric ceramic of the preferred embodiments and the comparative examples has a curve convex upward in a temperature range from −25° to 85° C. as shown in FIG. 1 Therefore, in the present preferred embodiments, the resonance frequency of each of the obtained products of dielectric ceramic was measured in a temperature range from −25° C. to 85° C. so as to represent (a) a change rate in the temperature for a higher temperature range from 20° to 60° C. by $\tau_{fH}$ ppm/° C. and (b) a change rate in the temperature for a lower temperature range from 20° to −25° C. by $\tau_{fL}$ ppm/° C., using a reference temperature of 20° C.

Tables 1 to 4 show the composition ratio x, the atomic ratios AR1 and AR2, the set firing temperature, the set atmosphere, the calculated relative dielectric constant, the measured Q value, and the measured change ratios $\tau_{fH}$ and $\tau_{fL}$ of the resonance frequency in the temperature of the sample dielectric ceramic of the preferred embodiments and the comparative examples which were obtained using the above-mentioned process. In Tables 1 to 4, the comparative examples are indicated by * marks. It is to be noted that the dielectric ceramic of the samples Nos. 1 to 22 shown in Tables 1 and 2 includes only a subcomponent of CuO, the dielectric ceramic of the samples Nos. 23 to 38 shown in Table 3 includes only a subcomponent of $V_2O_5$, and the dielectric ceramic of the samples Nos. 39 to 50 shown in Table 4 includes only subcomponents of CuO and $V_2O_5$.

As is apparent from Tables 1 to 4, each sample of dielectric ceramic of the embodiment, preferably applicable to the microwave devices such as dielectric resonators, has the following electrical characteristics:

(a) a high relative dielectric constant equal to or larger than 40 in the microwave band in a frequency range from 2 to 6 GHz;

(b) a Q value larger than 500; and (c) change ratios $\tau_{fH}$ and $\tau_{fL}$, each smaller than 100 ppm/° C. and larger than −100 ppm/° C.

Accordingly, as is apparent from Tables 1 and 2, in the case of the dielectric ceramic of $(Bi_2O_3)_x(Nb_2O_5)_{1-x}$ including a subcomponent of CuO, the composition ratio x is preferably within a range of $0.48 \leqq x \leqq 0.51$, and the above-defined atomic ratio AR1 is preferably within a range of $0<AR1\leqq0.01$.

Further, as is apparent from Table 3, in the case of the dielectric ceramic of $(Bi_2O_3)_x(Nb_2O_5)_{1-x}$ including a subcomponent of $V_2O_5$, the composition ratio x is preferably within a range of $0.48\leqq x\leqq0.51$, and the above-defined atomic ratio AR2 is preferably within a range of $0<AR2\leqq0.02$.

Furthermore, as is apparent from Table 4, in the case of the dielectric ceramic of $(Bi_2O_3)_x(Nb_2O_5)_{1-x}$ including subcomponents of CuO and $V_2O_5$, the composition ratio x is preferably fallen into a range of $0.48\leqq x\leqq0.51$, the above-defined atomic ratio AR1 is preferably within a range of $0<AR1\leqq0.01$, and the above-defined atomic ratio AR2 is preferably within a range of $0<AR2\leqq0.02$.

SECOND PREFERRED EMBODIMENT

A process of making a laminated dielectric resonator of a second preferred embodiment according to the present invention will be described below.

As starting materials of the dielectric ceramic for use as laminated dielectric layers, $Bi_2O_3$, $Nb_2O_5$, CuO and $V_2O_5$ each having a high purity i.e., having almost no impurity were used. With adjustment for purity made to the rate of addition of CuO and $V_2O_5$ to be both 0.1 mol% at $x=0.4985$ of $(Bi_2O_3)_x(Nb_2O_5)_{1-x}$, their predetermined amounts were weighed out, and then, the weighed materials were mixed for 17 hours in a ball mill using balls made of stabilized zirconia with pure water as a solvent. This mixture was filtered with suction, thereby separating almost all the water content thereof from the mixture, being followed by drying it, and then, the dried mixture was put in an alumina crucible and was calcined for 2 hours at a temperature range from 700° to 800° C. Then the calcined product was roughly crushed in an alumina mortar and was further pulverized for 17 hours in a ball mill using balls made of stabilized zirconia with pure water as a solvent. Thereafter, the product was filtered with suction, thereby separating almost all the water content thereof from the product, being followed by drying the product.

Then, a slurry obtained by mixing an organic binder, a solvent and a plasticizer with this calcined powder was turned into a sheet-shaped product using the doctor-blade method known to those skilled in the art. One metal was selected as an electrical conductor metal among various metals given in Table 5 were chosen, and then, the selected metal was kneaded with some vehicle into paste. For example, in the case of a conductor of Cu paste, CuO paste was utilized.

FIGS. 3 to 8 show one of laminated dielectric resonators of the second preferred embodiment according to the present invention.

Figure 3:
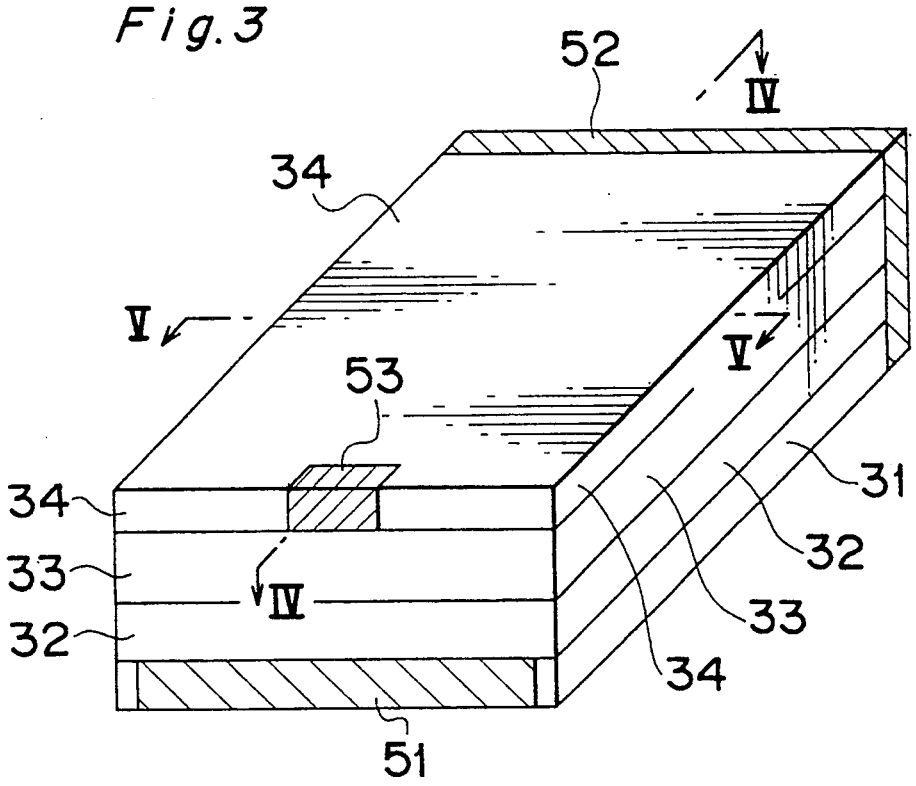
FIG. 3 is a schematic perspective view showing a laminated dielectric resonator of a second preferred embodiment according to the present invention.
Figure 4:
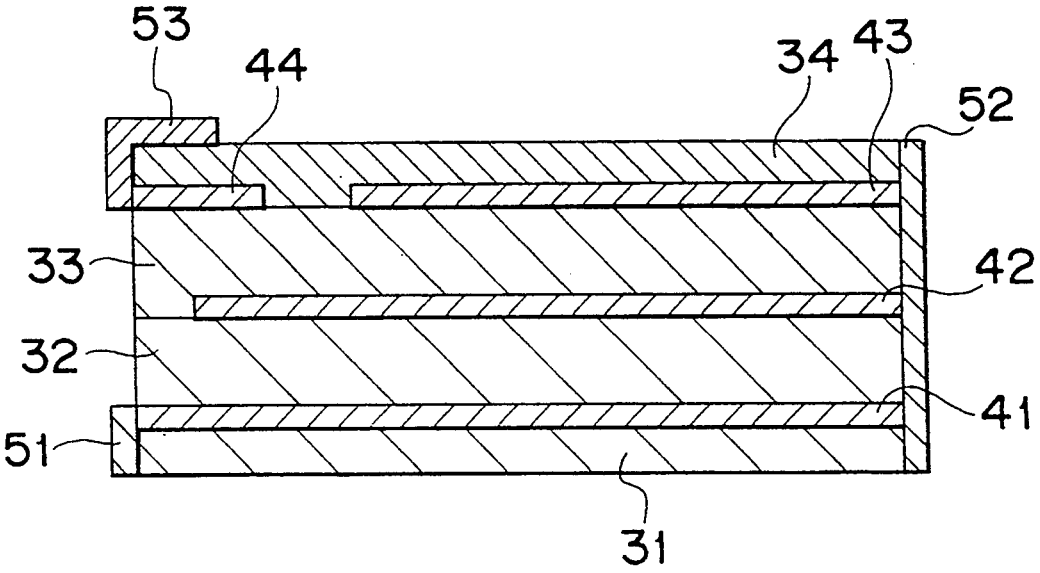
FIG. 4 is a longitudinal cross-sectional view on line IV—IV, of FIG. 3.
Figure 5:
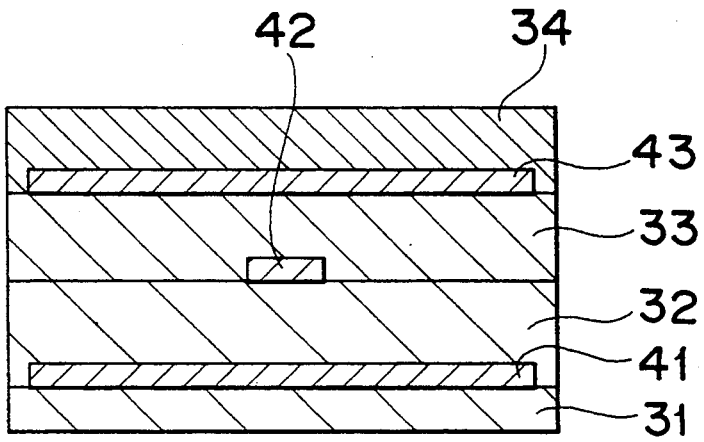
FIG. 5 is a longitudinal cross-sectional view on line V—V' of FIG. 3.
Figure 6:
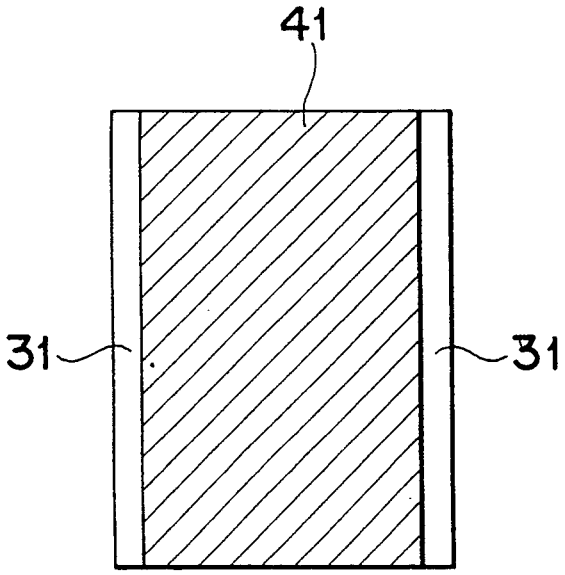
FIG. 6 is a plan view showing an electrical conductor pattern 41 formed on a laminated dielectric layer 31 of the dielectric resonator shown in FIG. 3.
Figure 7:
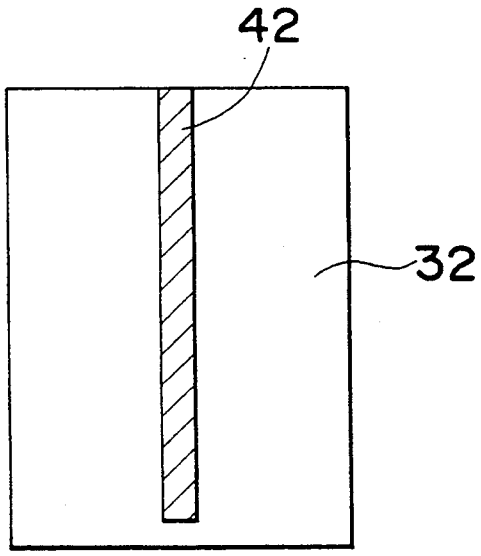
FIG. 7 is a plan view showing a microstrip conductor 42 formed on a laminated dielectric layer 32 of the dielectric resonator .shown in FIG. 3.
Figure 8:
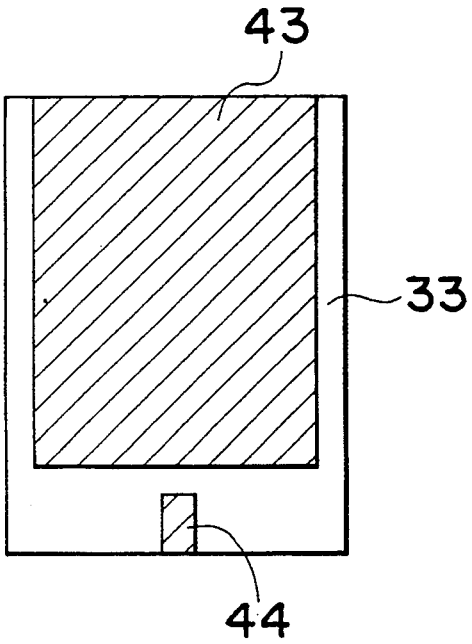
FIG. 8 is a plan view showing an electrode 42 and an electrical conductor pattern 43 formed on a laminated dielectric layer 33 of the dielectric resonator shown in FIG. 3.

As shown in FIGS. 3 to 5, a predetermined plurality of the aforementioned sheet-shaped products were laminated so as to make a dielectric layer 31, and then, a plurality conductor pattern each having a conductor pattern 41 shown in FIG. 6 were formed on the dielectric layer 31 using the screen printing method. Thereafter, a predetermined plurality of the aforementioned sheet-shaped products were laminated thereon so as to make a dielectric layer 32, and then, a plurality conductor pattern each having a microstrip conductor pattern 42 with a longitudinal length of 15 mm shown in FIG. 7 were formed on the dielectric layer 32 using the screen printing method. Thereafter, a predetermined plurality of the aforementioned sheet-shaped products were laminated thereon so as to make a dielectric layer 33, and then, a plurality conductor pattern each having conductor patterns 43 and 44 shown in FIG. 8 were formed on the dielectric layer 33 using the screen printing method. Further, a predetermined plurality of the aforementioned sheet-shaped products were laminated thereon so as to make a dielectric layer 34, and then, the obtained product was bonded under pressure by a hot pressing method.

Then this product was cut into individual resonator elements and was heated in air at 700° C. to dissipate the binder. In this process, when the CuO paste was used, it was heated in $H_2$ atmosphere to reduce the CuO paste to Cu, which was then fired in $N_2$ atmosphere. In the case of the conductors other than the CuO paste, each of them was fired in air or in $N_2$ atmosphere. The firing temperature in this firing process was preset at a temperature from 875° to 1000° C.

Then, as shown in FIGS. 3 and 4, to form external electrodes 51 to 53, Ag paste available on the market was burned thereonto at a temperature of 800° C., thereby obtaining a laminated dielectric resonator comprising the dielectric layers 31 to 34 of dielectric ceramic, shown in FIG. 3. It is to be noted that the length of the strip line of the microstrip conductor 42 after firing was fallen into a range from 13.7 to 13.9 mm.

In the laminated dielectric resonator of the present invention, as shown in FIGS. 3 and 4, the metal conductors 41 to 43 and the external electrode 51 are electrically connected to each other, and the metal conductor 44 is electrically connected to the external electrode 53. The laminated dielectric resonator is characterized in that, as shown in FIG. 4, a plurality of sheet-shaped dielectric layers 32 and 34 are formed between the metal conductor 44 which is electrically connected to one external electrode 53 and the metal conductors 41 to 43 which are electrically connected to another external electrode 51 thereby forming a microwave dielectric resonator. The metal microstrip conductor 42 electrically connected to another external electrode 51 is formed between the dielectric layers 32 and 33 of the dielectric ceramic.

For respective conductors shown in Table 5, 10 devices were manufactured, and then, their electric characteristics were measured and averaged.

Table 5 shows the resonance frequency and the nonloaded Q value of each of the laminated dielectric resonators each having the metal conductor patterns 41 to 44, which were obtained when each device was fired in air or nitrogen atmosphere under a condition of an oxygen concentration equal to or less than 10, 1000 or 10000 ppm. In the conductive electrode of Table 5, it is to be noted that, for example, 99Ag - 1Pt denotes an alloy of Ag of 99 wt% and Pt of 1 wt%.

As is apparent from Table 5, all the obtained laminated dielectric resonators each using Cu, Ag, Au or an alloy of Ag and Pt as the metal conductor patterns 41 to 44 have a resonance frequency of around 830 MHz and Q values higher than 80. Therefore, all the obtained laminated dielectric resonators can be applicable to microwave resonators. Further, microwave band-pass filters and antenna combiners can be made using the microwave resonators of the aforementioned laminated dielectric resonators.

In the second preferred embodiment, the alloy of Ag and Pt is used as the conductive electrode. The present invention is not limited to this, and there may be used an alloy of Ag and Pd and an alloy of Cu and Pd.

In particular, as is apparent from Table 5, when the element was fired in nitrogen atmosphere under a condition of an oxygen concentration equal to or less than 1000 ppm using Ag, Au or an alloy of Ag and Pt as the metal conductors, the Q value of the laminated dielectric resonator was equal to or higher than 170, since the reactions between the metal conductors and the dielectric layers were suppressed by using the firing method in nitrogen atmosphere, i.e., deterioration of the electric characteristics was lowered due to the impurity (the metal conductor of Ag or the like) of the dielectric and also generation of fine delamination thereof was suppressed. Thus obtained Q value thereof was extremely higher than that of the laminated dielectric resonators obtained after firing in atmosphere under a condition of an oxygen concentration higher than 1000 ppm.

Therefore, as described above, the resonator element is preferably fired in nitrogen atmosphere under a condition of an oxygen concentration equal to or less than 1000 ppm.

When a conventional laminated dielectric resonator of the same structure was manufactured using a conventional substrate material with a relative dielectric constant of about 8, it is necessary to form a strip line of the conductor pattern 42 having a length of about 31.5 mm in order to obtain the same resonance frequency as 830 MHz. On the other hand, each of the laminated dielectric resonators of the second preferred embodiment according to the present invention has a strip line of the conductor pattern 42 having a length ranging from about 13.7 to 13.9 mm, resulting in a smaller-sized laminated dielectric resonator.

A conventional strip line resonator using dielectric ceramic has a structure wherein a microstrip conductor for a strip line is formed on a dielectric substrate or layer. On the other hand, the laminated dielectric resonator of the second preferred embodiment according to the present invention has a structure in which a microstrip conductor for a strip line is formed between respective sheet-shaped dielectric layers each having relative dielectric constant higher than that of the conventional one.

In general, a longitudinal length L of a conventional $\lambda/4$ length type strip line resonator is expressed as follows:

$$L \cong \frac{c}{4f\sqrt{\epsilon_w}}, \tag{3}$$

where c is the speed of light, f is a resonance frequency of the $\lambda/4$ length type strip line resonator, and $\epsilon_w$ is an effective dielectric constant of a dielectric layer thereof.

Therefore, the effective dielectric constant $\epsilon_w$ of the conventional strip line resonator is within a range from 0.6 $\epsilon_r$ to 0.9 $\epsilon_r$, where $\epsilon_w$ is a relative dielectric constant of a dielectric layer since one side surface of the strip line is exposed to air. On the other hand, in the laminated dielectric resonator having the structure of the second preferred embodiment shown in FIGS. 3 and 4 in which the microstrip conductor of the conductor pattern 42 is formed between the dielectric layers 32 and 33, the effective dielectric constant $\epsilon_w$ thereof becomes substantially the same as the relative dielectric constant $\epsilon_r$ of the dielectric layers thereof. Therefore, the size of the laminated dielectric resonator of the second preferred embodiment becomes extremely smaller than that of the conventional strip line resonator.

A plurality of aforementioned laminated dielectric resonators may be further laminated, or alternatively, may be combined with elements such as capacitors or the like, resulting in a laminated dielectric type microwave device such as a microwave band-pass filter.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

TABLE 1

| Sample No. | Composition ratio x | Atomic ratio AR1 | Firing temperature | Atmosphere | Relative dielectric constant | Q | Change rate of Resonance frequency in temperature (ppm/°C.) $\tau_{fL}$ | $\tau_{fH}$ |
|---|---|---|---|---|---|---|---|---|
| 1 | 0.4985 | $7.5 \times 10^{-4}$ | 975 | Air | 44 | 2239 | 23 | −21 |
| 2 | 0.4975 | $7.5 \times 10^{-4}$ | 975 | Air | 44 | 3170 | 13 | −34 |
| 3 | 0.5 | $7.5 \times 10^{-4}$ | 975 | Air | 45 | 996 | 22 | −17 |
| | | | | $N_2$ | 44 | 1362 | 41 | 1 |
| 4 | 0.505 | $7.5 \times 10^{-4}$ | 975 | Air | 45 | 621 | 43 | −8 |
| 5 | 0.51 | $7.5 \times 10^{-4}$ | 975 | Air | 45 | 508 | 92 | 14 |
| 6* | 0.52 | $7.5 \times 10^{-4}$ | 975 | Air | 44 | 328 | 158 | 29 |
| | | | | $N_2$ | 43 | 340 | 172 | 43 |
| 7 | 0.49 | $7.5 \times 10^{-4}$ | 975 | Air | 43 | 792 | −17 | −85 |
| 8 | 0.48 | $7.5 \times 10^{-4}$ | 975 | Air | 42 | 510 | −28 | −98 |
| 9* | 0.47 | $7.5 \times 10^{-4}$ | 975 | Air | 40 | 368 | −37 | −129 |
| | | | | $N_2$ | 39 | 211 | −8 | −70 |
| 10 | 0.4985 | $2.5 \times 10^{-4}$ | 975 | Air | 42 | 3767 | 37 | 2 |
| | | | | $N_2$ | 42 | 3333 | 38 | 4 |
| 11 | 0.4985 | $5.0 \times 10^{-4}$ | 975 | Air | 43 | 4104 | 30 | −12 |

TABLE 2

| Sample No. | Composition ratio x | Atomic ratio AR1 | Firing temperature | Atmosphere | Relative dielectric constant | Q | Change rate of Resonance frequency in temperature (ppm/°C.) $\tau_{fL}$ | $\tau_{fH}$ |
|---|---|---|---|---|---|---|---|---|
| 12 | 0.4985 | $1.5 \times 10^{-3}$ | 975 | Air | 46 | 1528 | 7 | −57 |
| 13 | 0.4985 | $2.5 \times 10^{-3}$ | 975 | Air | 47 | 1020 | 13 | −78 |
| | | | | $N_2$ | 45 | 2121 | 30 | −9 |
| 14 | 0.4985 | $5.0 \times 10^{-3}$ | 975 | Air | 47 | 769 | −31 | −82 |
| | | | | $N_2$ | 42 | 1862 | 26 | −18 |
| 15 | 0.4985 | $7.5 \times 10^{-3}$ | 950 | $N_2$ | 42 | 1217 | 12 | −34 |
| 16 | 0.4985 | $1.0 \times 10^{-2}$ | 950 | $N_2$ | 43 | 922 | −2 | −82 |
| 17* | 0.4985 | $1.25 \times 10^{-2}$ | 950 | $N_2$ | 44 | 539 | −29 | −124 |
| 18 | 0.495 | $2.5 \times 10^{-4}$ | 975 | Air | 41 | 1215 | 10 | −51 |
| 19 | 0.495 | $7.5 \times 10^{-4}$ | 975 | Air | 43 | 1179 | −5 | −67 |
| | | | | $N_2$ | 43 | 995 | 35 | 1 |
| 20 | 0.4975 | $2.5 \times 10^{-4}$ | 975 | Air | 41 | 2636 | 25 | −18 |
| | | | | $N_2$ | 40 | 1748 | 32 | 5 |
| 21 | 0.4975 | $1.5 \times 10^{-3}$ | 975 | Air | 46 | 1356 | −6 | −69 |
| 22 | 0.5 | $2.5 \times 10^{-4}$ | 975 | Air | 41 | 1341 | 10 | −51 |

TABLE 3

| Sample No. | Composition ratio x | Atomic ratio AR1 | Firing temperature | Atmosphere | Relative dielectric constant | Q | Change rate of Resonance frequency in temperature (ppm/°C.) $\tau_{fL}$ | $\tau_{fH}$ |
|---|---|---|---|---|---|---|---|---|
| 23 | 0.4985 | $7.5 \times 10^{-4}$ | 925 | Air | 44 | 2746 | 36 | 3 |
| 24 | 0.4975 | $7.5 \times 10^{-4}$ | 925 | Air | 45 | 1385 | 26 | −6 |
| 25 | 0.5 | $7.5 \times 10^{-4}$ | 950 | Air | 44 | 1337 | 24 | 4 |
| 26 | 0.505 | $7.5 \times 10^{-4}$ | 950 | Air | 44 | 911 | 21 | −22 |
| 27 | 0.51 | $7.5 \times 10^{-4}$ | 950 | Air | 44 | 726 | 10 | −42 |
| 28* | 0.52 | $7.5 \times 10^{-4}$ | 950 | Air | 44 | 488 | −2 | −59 |
| 29 | 0.495 | $7.5 \times 10^{-4}$ | 950 | Air | 43 | 1116 | 26 | −10 |
| 30 | 0.48 | $7.5 \times 10^{-4}$ | 950 | Air | 44 | 524 | 69 | 18 |
| 31* | 0.47 | $7.5 \times 10^{-4}$ | 950 | Air | 44 | 308 | 91 | 29 |
| 32 | 0.4985 | $2.5 \times 10^{-4}$ | 1000 | Air | 42 | 2800 | 40 | 3 |
| 33 | 0.4985 | $5.0 \times 10^{-4}$ | 950 | Air | 44 | 2504 | 39 | 4 |
| | | | | $N_2$ | 44 | 1695 | 34 | 1 |
| 34 | 0.4985 | $1.5 \times 10^{-3}$ | 875 | Air | 43 | 1903 | 35 | 1 |
| | | | | $N_2$ | 43 | 1297 | 35 | −1 |
| 35 | 0.4985 | $2.5 \times 10^{-3}$ | 875 | Air | 43 | 1565 | 31 | −2 |
| 36 | 0.4985 | $5.0 \times 10^{-3}$ | 875 | Air | 45 | 901 | 21 | −7 |
| 37 | 0.4985 | $2.0 \times 10^{-2}$ | 875 | Air | 46 | 534 | 27 | −7 |
| 38* | 0.4985 | $3.0 \times 10^{-2}$ | 875 | Air | 46 | 411 | 28 | −9 |

TABLE 4

| Sample No. | Composition ratio x | Atomic ratio AR2 | Atomic ratio AR1 | Firing temperature | Atmosphere | Relative dielectric constant | Q | Change rate of Resonance frequency (ppm/°C.) $\tau_{fL}$ | $\tau_{fH}$ |
|---|---|---|---|---|---|---|---|---|---|
| 39 | 0.4985 | $2.5 \times 10^{-4}$ | $2.5 \times 10^{-4}$ | 950 | Air | 45 | 4065 | 34 | −1 |
| | | | | | $N_2$ | 43 | 3062 | 30 | −4 |
| 40 | 0.4985 | $2.5 \times 10^{-4}$ | $5.0 \times 10^{-4}$ | 925 | Air | 44 | 2461 | 31 | 1 |
| 41 | 0.4985 | $2.5 \times 10^{-4}$ | $7.5 \times 10^{-4}$ | 900 | $N_2$ | 44 | 1843 | 17 | −13 |
| 42 | 0.4985 | $5.0 \times 10^{-4}$ | $2.5 \times 10^{-4}$ | 900 | Air | 43 | 2600 | 29 | −5 |
| 43 | 0.4985 | $5.0 \times 10^{-4}$ | $5.0 \times 10^{-4}$ | 875 | Air | 43 | 4258 | 38 | 3 |
| | | | | | $N_2$ | 44 | 2366 | 32 | −4 |
| 44 | 0.4985 | $5.0 \times 10^{-4}$ | $7.5 \times 10^{-4}$ | 875 | Air | 44 | 2714 | 31 | −3 |
| | | | | | $N_2$ | 44 | 1435 | 23 | −22 |
| 45 | 0.4985 | $5.0 \times 10^{-4}$ | $2.5 \times 10^{-3}$ | 850 | $N_2$ | 43 | 1401 | 19 | −31 |
| 46 | 0.4985 | $5.0 \times 10^{-4}$ | $1.0 \times 10^{-2}$ | 850 | $N_2$ | 43 | 609 | 2 | −59 |
| 47* | 0.4985 | $5.0 \times 10^{-4}$ | $1.5 \times 10^{-2}$ | 850 | $N_2$ | 43 | 397 | −14 | −77 |
| 48 | 0.4985 | $7.5 \times 10^{-4}$ | $2.5 \times 10^{-4}$ | 875 | Air | 44 | 2457 | 36 | 0 |
| 49 | 0.4985 | $7.5 \times 10^{-4}$ | $5.0 \times 10^{-4}$ | 875 | Air | 45 | 3180 | 37 | 3 |
| | | | | | $N_2$ | 45 | 1968 | 27 | −3 |
| 50 | 0.4985 | $7.5 \times 10^{-4}$ | $7.5 \times 10^{-4}$ | 850 | Air | 45 | 2694 | 36 | 1 |

TABLE 5

| Conductive electrode | Atmosphere | Resonance frequency (MHz) | Non-loaded Q |
|---|---|---|---|
| Cu | $N_2$ | 831 | 82 |
| Au | Air | 830 | 113 |
| Ag | Air | 832 | 104 |
| 99Ag-1Pt | Air | 821 | 97 |
| 95Ag-5Pt | Air | 829 | 98 |
| Au | $N_2$ ($O_2$ concentration: 10000 ppm) | 830 | 138 |
| Ag | $N_2$ ($O_2$ concentration: 10000 ppm) | 834 | 129 |
| 99Ag-1Pt | $N_2$ ($O_2$ concentration: 10000 ppm) | 825 | 119 |
| 95Ag-5Pt | $N_2$ ($O_2$ concentration: 10000 ppm) | 826 | 127 |
| Au | $N_2$ ($O_2$ concentration: 1000 ppm) | 833 | 189 |
| Ag | $N_2$ ($O_2$ concentration: 1000 ppm) | 837 | 191 |
| 99Ag-1Pt | $N_2$ ($O_2$ concentration: 1000 ppm) | 827 | 180 |
| 95Ag-5Pt | $N_2$ ($O_2$ concentration: 1000 ppm) | 828 | 179 |
| Au | $N_2$ ($O_2$ concentration: 10 ppm) | 832 | 202 |
| Ag | $N_2$ ($O_2$ concentration: 10 ppm) | 836 | 207 |
| 99Ag-1Pt | $N_2$ ($O_2$ concentration: 10 ppm) | 825 | 194 |
| 95Ag-5Pt | $N_2$ ($O_2$ concentration: 10 ppm) | 824 | 191 |

What is claimed is:

1. Dielectric ceramic for use in a microwave device made of $(Bi_2O_3)_x(Nb_2O_5)_{1-x}$ including a subcomponent of CuO, wherein the composition ration x is within a range of $0.48 \leqq x \leqq 0.51$, and an atomic ratio AR1 defined by the following equations:

$$AR1 = (\text{the number of Cu atoms of said CuO})/ARO, \text{ and}$$

$$AR0 = (\text{the number of Bi atoms of said } (Bi_2O_3)_x(Nb_2O_5)_{1-x}) + (\text{the number of Nb atoms of said } (Bi_2O_3)_x(Nb_2O_5)_{1-x})$$

is within a range of $0 < Ar1 \leqq 0.01$, said dielectric ceramic being fired at a temperature in a range from 875° C. to 1000° C.

2. Dielectric ceramic for use in a microwave device made of $(Bi_2O_3)_x(Nb_2O_5)_{1-x}$ including a subcomponent of $V_2O_5$, wherein the composition ration x is within a range of $0.48 \leqq x \leqq 0.51$, and an atomic ratio AR2 defined by the following equations:

$$AR2 = (\text{the number of V atoms of said } V_2O_5)/ARO, \text{ and}$$

$$AR0 = (\text{the number of Bi atoms of said } (Bi_2O_3)_x(Nb_2O_5)_{1-x}) + (\text{the number of Nb atoms of said } (Bi_2O_3)_x(Nb_2O_5)_{1-x})$$

is within a range of $0 < AR2 \leqq 0.02$, said dielectric ceramic being fired at a temperature in a range between 875° C. to 1000° C.

3. Dielectric ceramic for use in a microwave device made of $(Bi_2O_3)_x(Nb_2O_5)_{1-x}$ including subcomponents of CuO and $V_2O_5$, wherein the composition ratio x is within a range of $0.48 \leqq x \leqq 0.51$, an atomic ratio AR1 defined by the following equations:

$$AR1 = (\text{the number of Cu atoms of said CuO})/ARO, \text{ and}$$

$$AR0 = (\text{the number of Bi atoms of said } (Bi_2O_3)_x(Nb_2O_5)_{1-x}) + (\text{the number of Nb atoms of said } (Bi_2O_3)_x(Nb_2O_5)_{1-x})$$

is within a range of $0 < AR1 \leqq 0.01$, and another atomic range AR2 defined by the following equation:

$$AR2 = (\text{the number of V atoms of said } V_2O_5)/(ARO$$

is within a range of $0 < AR2 \leqq 0.02$, said dielectric ceramic being fired at a temperature in a range form 875° C. to 1000° C.

4. A microwave dielectric resonator comprising:

first and second external electrodes;

first and second conductors electrically connected to said first and second external electrodes, respectively;

a plurality of first sheet-shaped dielectric layers and a plurality of second sheet-shaped dielectric layers both formed between said first and second conductors, said first and second dielectric layers being made of dielectric ceramics; and a microstrip conductor formed between said plurality of first sheet-shaped dielectric layers and said plurality of second sheet-shaped dielectric layers, said microstrip conductor being electrically connected to said second external electrode, wherein each of said first and second conductors and said microstrip conductor is made of a compound selected from a group consisting of Cu, Ag, Au, an alloy of Ag and Pt, an alloy of Ag and Pd, and an alloy of Cu and Pd, and said dielectric ceramic of said first and second sheet-shaped dielectric layers are made of $(Bi_2O_3)_x(Nb_2O_5)_{1-x}$ including a subcomponent of CuO, where the composition ratio x is within a range of $0.48 \leqq x \leqq 0.51$, and an atomic ratio AR1 defined by the following equations:

$$AR1 = (\text{the number of Cu atoms of said CuO})/ARO, \text{ and}$$

$$AR0 = (\text{the number of Bi atoms of said } (Bi_2O_3)_x(Nb_2O_5)_{1-x}) + (\text{the number of Nb atoms of said } (Bi_2O_3)_x(Nb_2O_5)_{1-x})$$

is within a range of $0 < AR1 \leqq 0.01$, said dielectric ceramic being fired at a temperature in a range from 875° C. to 1000° C.

5. A microwave dielectric resonator comprising:

first and second external electrodes;

first and second conductors electrically connected to said first and second external electrodes, respectively;

a plurality of first sheet-shaped dielectric layers and a plurality of second sheet-shaped dielectric layers both formed between said first and second conductors, said first and second dielectric layers being made of dielectric ceramics; and a microstrip conductor formed between said plurality of first sheet-shaped dielectric layers and said plurality of second sheet-shaped dielectric layers, said microstrip conductor being electrically connected to said second external electrode, wherein each of said first and second conductors and said microstrip conductor is made of a compound selected from a group consisting of Cu, Ag, Au, an alloy of Ag and Pt, an alloy of Ag and Pd, and an alloy of Cu and Pd, and said dielectric ceramics of said first and second sheet-shaped dielectric layers are made of $(Bi_2O_3)_x(N$-

$b_2O_5)_{1-x}$ including a subcomponents of $V_2O_5$, where the composition ratio x is within a range of $0.48 \leqq x \leqq 0.51$and an atomic ratio AR2 defined by the following equations:

*AR2=(the number of V atoms of said $V_2O_5$)/ARO, and*

*AR0=(the number of Bi atoms of said $(Bi_2O_3)_x(Nb_2O_5)_{1-x}$)+(the number of Nb atoms of said $(Bi_2O_3)_x(Nb_2O_5)_{1-x}$)* is within a range of $0<AR2 \leqq 0.02$, said dielectric ceramic being fired at a temperature in a range from 875° C. to 1000° C.

6. A microwave dielectric resonator comprising:

first and second external electrodes;

first and second conductors electrically connected to said first and second external electrodes, respectively;

a plurality of first sheet-shaped dielectric layers and a plurality of second sheet-shaped dielectric layers both formed between said first and second conductors, said first and second dielectric layers being made of dielectric ceramics; and a microstrip conductor formed between said plurality of first sheet-shaped dielectric layers and said plurality of second sheet-shaped dielectric layers, said microstrip conductor being electrically connected to said second external electrode, wherein each of said first and second conductors and said microstrip conductor is made of a compound selected from a group consisting of Cu, Ag, Au, an alloy of Ag and Pt, an alloy of Ag and Pd, and an alloy of Cu and Pd, and said dielectric ceramics of said first and second sheet-shaped dielectric layers are made of $(Bi_2O_3)_x(Nb_2O_5)_{1-x}$ including a subcomponents of CuO and $V_2O_5$, where the composition ratio x is within a range of $0.48 \leqq x \leqq 0.51$, an atomic ratio AR1 defined by the following equations:

*AR1=(the number of Cu atoms of said CuO)/ARO, and*

*AR0=(the number of Bi atoms of said $(Bi_2O_3)_x(Nb_2O_5)_{1-x}$)+(the number of Nb atoms of said $(Bi_2O_3)_x(Nb_2O_5)_{1-x}$)* is within a range of $0<AR1 \leqq 0.01$, and another atomic ratio AR2 defined by the following equation:

*AR2=(the number of V atoms of said $V_2O_5$)/ARO* is within a range of $0<AR2 \leqq 0.02$, said dielectric ceramic being fired at a temperature in a range from 875° C. to 1000° C.

7. The dielectric ceramic according to claim 1, wherein said dielectric ceramic has a relative dielectric constant equal to or greater than 40 in a microwave band including the frequency range from 2 to 6 GHz, a Q value greater than 500 in said microwave band, and an absolute value of a change ratio of a resonance frequency less than 100 ppm/° C. in said microwave band in a temperature range from −25° to 85° C.

8. The dielectric ceramic according to claim 2, wherein said dielectric ceramic has a relative dielectric constant equal to or greater than 40 in a microwave band including the frequency range from 2 to 6 GHz, a Q value greater than 500 in said microwave band, and an absolute value of a change ratio of a resonance frequency less than 100 ppm/° C. in said microwave band in a temperature range from −25° to 85° C.

9. The dielectric ceramic according to claim 3, wherein said dielectric ceramic has a relative dielectric constant equal to or greater than 40 in a microwave band including the frequency range from 2 to 6 GHz, a Q value greater than 600 in said microwave band, and an absolute value of a change ratio of a resonance frequency less than 100 ppm/° C. in said microwave band in a temperature range from −25° to 85° C.

10. The microwave dielectric resonator according to claim 4, wherein said dielectric ceramic has a relative dielectric constant equal to or greater than 40 in a microwave band including the frequency range from 2 to 6 GHz, a Q value greater than 500 in said microwave band, and an absolute value of a change ratio of a resonance frequency less than 100 ppm/° C. in said microwave band in a temperature range from −25° to 85° C.

11. The microwave dielectric resonator according to claim 5, wherein said dielectric ceramic has a relative dielectric constant equal to or greater than 40 in a microwave band including the frequency range from 2 to 6 GHz, a Q value greater than 500 in said microwave band, and an absolute value of a change ratio of a resonance frequency less than 100 ppm/° C. in said microwave band in a temperature range from −25° to 85° C.

12. The microwave dielectric resonator according to claim 6, wherein said dielectric ceramic has a relative dielectric constant equal to or greater than 40 in a microwave band including the frequency range from 2 to 6 GHz, a Q value greater than 600 in said microwave band, and an absolute value of a change ratio of a resonance frequency less than 100 ppm/° C. in said microwave band in a temperature range from −25° to 85° C.

* * * * *

UNITED STATES PATENT AND TRADEMARK OFFICE

CERTIFICATE OF CORRECTION

PATENT NO. : 5,350,639

DATED : September 27, 1994

INVENTOR(S) : Tatsuya Inoue et al.

It is certified that error appears in the above-indentified patent and that said Letters Patent is hereby corrected as shown below:

Title Page, Title: should read --DIELECTRIC CERAMIC FOR USE IN MICROWAVE DEVICE, A MICROWAVE DIELECTRIC CERAMIC RESONATOR--.

Title Page, Abstract, Line 2: "ceramics should read --ceramics for use in--.

Title Page, Abstract, Line 12: "0<AR1<0.01," should read --0<AR1≤0.01,--.

Column 2, Line 41: "$(Bi_2O_3)x(NbO_5)1-x$" should read --$(Bi_2O_3)_x(Nb_2O_5)_{1-x}$--.

Column 2, Line 52: "0<AR1<0.01" should read --0<AR1≤0.01--.

Column 2, Line 64: "into a" should read --a--.

Column 3, Line 13: "into a" should read --a--.

Column 3, Line 37: "into a" should read --a--.

Column 3, Line 42: "into a" should read --a--.

Column 4, Line 2: "into a" should read --a--.

Column 4, Line 26: "including at least" should read --including--.

Column 4, Line 27: "into a" should read --a--.

Column 4, Line 32: "into a" should read --a--.

UNITED STATES PATENT AND TRADEMARK OFFICE

CERTIFICATE OF CORRECTION

PATENT NO. : 5,350,639
DATED : September 27, 1994
INVENTOR(S) : Tatsuya Inoue et al.

It is certified that error appears in the above-indentified patent and that said Letters Patent is hereby corrected as shown below:

Column 4, Line 57: "made of made of" should read --made of--.

Column 5, Line 9: "into a" should read --a--.

Column 5, Line 29: "made of made of" should read --made of--.

Column 6, Line 2: "made of made of" should read --made of--.

Column 6, Line 19: "$0.48 \leq \leq \leq 0.51$" should read --$0.48 \leq X \leq 0.51$--.

Column 6, Line 24: "into a" should read --a--.

Column 6, Line 52: "V-V' " should read --V-V--.

Column 7, Line 38: "ceramics" should read --ceramic--.

Column 8, Line 53: "ceramic" should read --ceramics--.

Column 9, Line 12: "fallen into" should read --within--.

Column 9, Line 33: "it," should read --the mixture--.

Column 11, Line 34: "ceramic" should read --ceramics--.

Column 15, Table 5, Column 3, Line 9: "829" should read --820--.

Column 15, Line 25: "ration" should read --ratio--.

Column 15, Line 42: "ration" should read --ratio--.

UNITED STATES PATENT AND TRADEMARK OFFICE

CERTIFICATE OF CORRECTION

PATENT NO. : 5,350,639
DATED : September 27, 1994
INVENTOR(S) : Tatsuya Inoue et al.

It is certified that error appears in the above-indentified patent and that said Letters Patent is hereby corrected as shown below:

Column 16, Line 9: "form" should read --from--.

Column 17, Line 1: "subcomponents" should read --subcomponent--.

Column 17, Line 38: "subcomponents" should read --subcomponent--.

Signed and Sealed this

Twelfth Day of December, 1995

*Attest:*

Bruce Lehman

BRUCE LEHMAN

*Attesting Officer*

*Commissioner of Patents and Trademarks*